US011056839B2

(12) United States Patent
Hsu et al.

(10) Patent No.: US 11,056,839 B2
(45) Date of Patent: Jul. 6, 2021

(54) CABLE CONNECTOR ASSEMBLY AND ASSEMBLING METHOD OF THE SAME

(71) Applicants: New Ocean Precision Component (Jiangxi) Co., Ltd., Yichun (CN); FOXCONN INTERCONNECT TECHNOLOGY LIMITED, Grand Cayman (KY)

(72) Inventors: Yang-Tsun Hsu, New Taipei (TW); Xu-Xiang Qi, Kunshan (CN); Jun-Cheng Lin, New Taipei (TW)

(73) Assignees: New Ocean Precision Component (Jiangxi) Co., Ltd., Yichun (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/745,376

(22) Filed: Jan. 17, 2020

(65) Prior Publication Data

US 2020/0244012 A1 Jul. 30, 2020

(30) Foreign Application Priority Data

Jan. 28, 2019 (CN) ..... 201910080696.6

(51) Int. Cl.
*H01R 13/6592* (2011.01)
*H01R 43/20* (2006.01)
*H01R 13/502* (2006.01)

(52) U.S. Cl.
CPC ..... *H01R 13/6592* (2013.01); *H01R 13/502* (2013.01); *H01R 43/20* (2013.01)

(58) Field of Classification Search
CPC ..... H01R 13/502; H01R 13/504; H01R 13/6592; H01R 43/20
See application file for complete search history.

(56) References Cited

U.S. PATENT DOCUMENTS

| | | | | |
|---|---|---|---|---|
| 7,758,374 | B2 * | 7/2010 | Yu | H01R 13/65912 439/493 |
| 9,515,439 | B2 | 12/2016 | Ng et al. | |
| 2010/0178794 | A1 * | 7/2010 | Hsu | H01R 9/031 439/391 |
| 2011/0195609 | A1 * | 8/2011 | Su | H01R 4/2433 439/660 |
| 2018/0375232 | A1 | 12/2018 | Wu et al. | |
| 2019/0288418 | A1 * | 9/2019 | Zhong | H01R 12/53 |
| 2020/0161789 | A1 * | 5/2020 | Flaherty, IV | H01R 13/2421 |

* cited by examiner

*Primary Examiner* — Oscar C Jimenez
(74) *Attorney, Agent, or Firm* — Ming Chieh Chang; Wei Te Chung

(57) ABSTRACT

A cable connector assembly includes: an electrical connector including a plug and a metal shell disposed outside the plug and the cable; a cable electrically connected with the electrical connector, the cable including plural core wires, an inner shield layer covering the core wires, a metal braided layer covering outside the inner shield layer, and an outer cover layer; and an inner mold integrally formed on the core wire to fix each core wire at a predetermined position.

6 Claims, 8 Drawing Sheets

CABLE CONNECTOR ASSEMBLY AND ASSEMBLING METHOD OF THE SAME

BACKGROUND OF THE DISCLOSURE

1. Field of the Disclosure

The present disclosure relates to a cable connector assembly and assembling method of the same, in particular to a structure for limiting and fixing core wire of cable connector assembly and assembling method of the same.

2. Description of Related Arts

U.S. Pat. No. 7,371,118 discloses a cable connector which includes an electrical connector, a cable electrically connected to the electrical connector, and a case disposed outside the electrical connector and the cable. The electrical connector includes an insulative housing, a plurality of conductive terminals received in the insulative housing, and a metallic shell disposed outside the insulative housing. The cable includes a plurality of core wires and an insulative layer covering the outside of the core wires. The core wires are electrically connected to the corresponding conductive terminals. The rear end of the metallic shell is riveted on the insulative layer of the cable. During assembling, because the core wires is not restrained by any fixing structure, it may be necessary to use a jig for positioning and soldered each core wire to the corresponding cable. The process is complicated such that production cost is high, and the longer inner shielding layer needs to be peeled off, which to a certain degree impacts on the high frequency performance of the cable connector.

Therefore, an improved cable connector assembly is desired.

SUMMARY OF THE DISCLOSURE

Accordingly, an object of the present disclosure is to provide a cable connector assembly with lower production cost and good high frequency performance.

To achieve the above object, a cable connector assembly comprises: an electrical connector including a plug and a metal shell disposed outside the plug and the cable; a cable electrically connected with the electrical connector, the cable including a plurality of core wires, an inner shield layer covering the core wires, a metal braided layer covering outside the inner shield layer, and an outer cover layer; and an inner mold integrally formed on the core wire to fix each core wire at a predetermined position.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
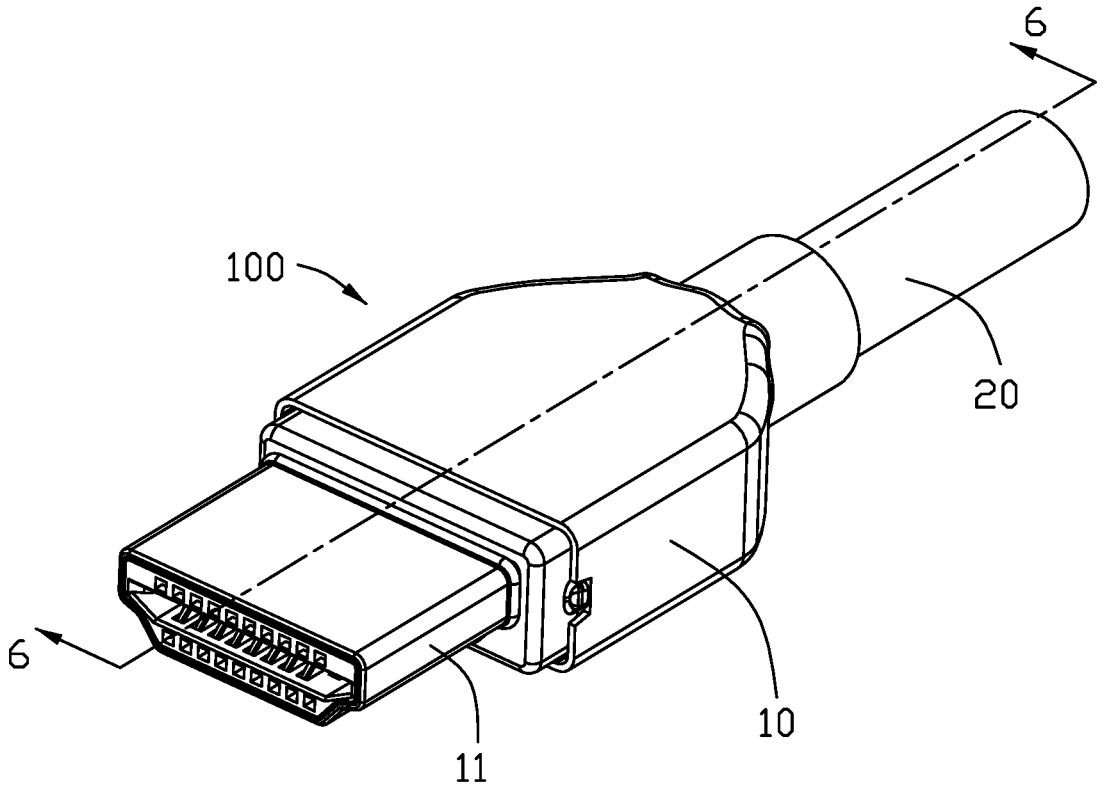
FIG. 1 is a perspective view of a cable connector assembly according to the present invention.
Figure 2:
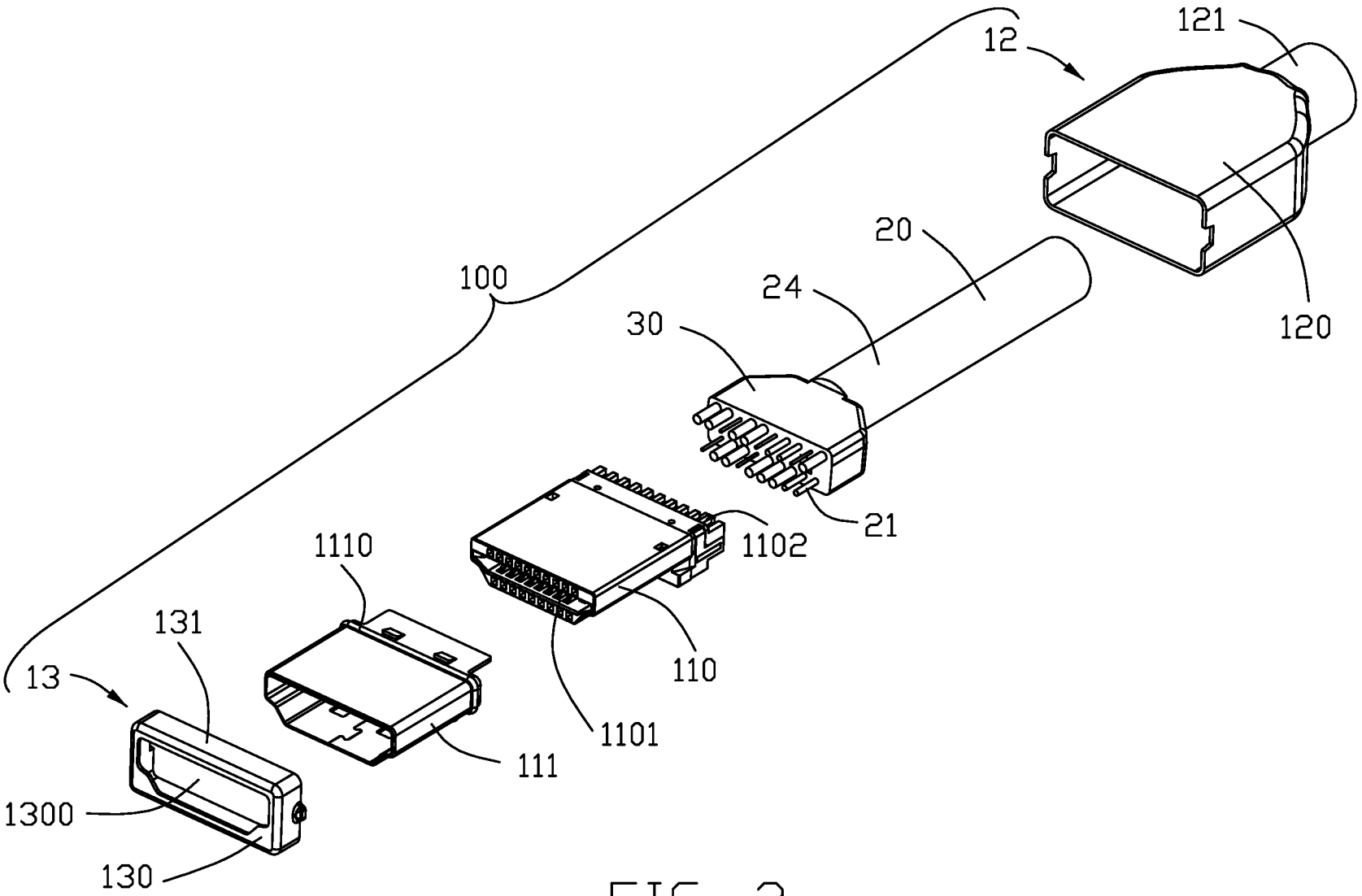
FIG. 2 is an exploded view of the cable connector assembly as shown in FIG. 1.
Figure 3:
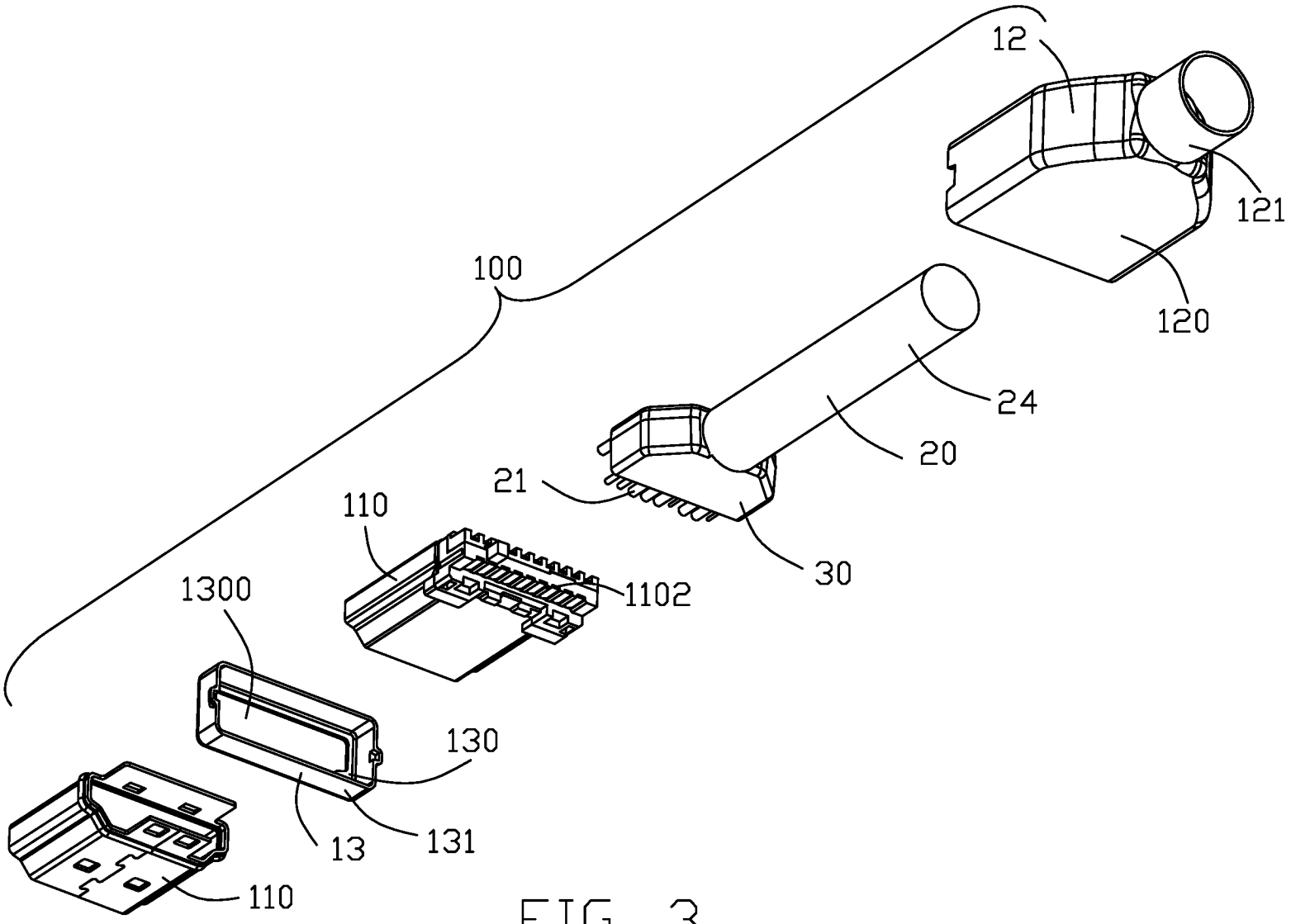
FIG. 3 is another exploded view of the cable connector assembly as shown in FIG. 2.
Figure 4:
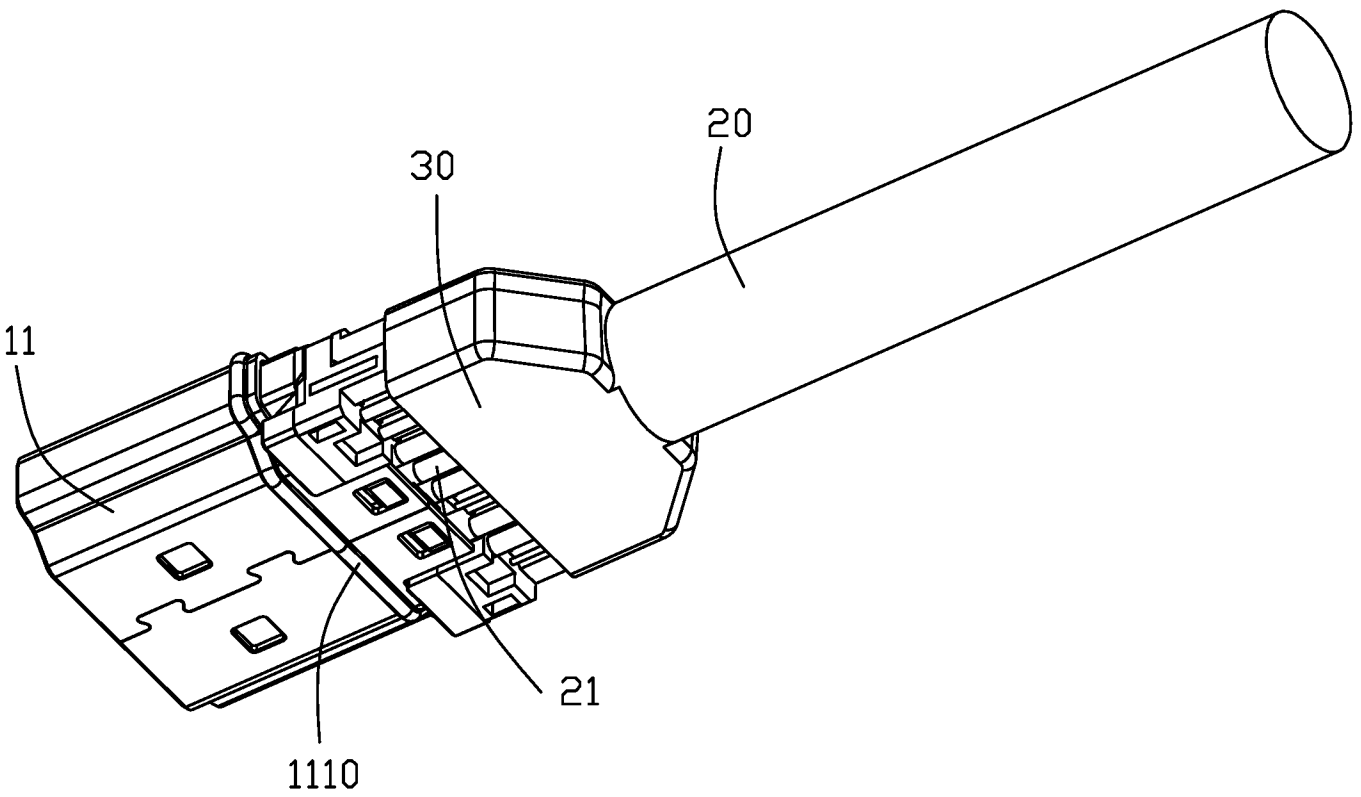
FIG. 4 is a perspective view of a cable of the cable connector assembly molding inner mold is connected with the plug as shown in FIG. 1.
Figure 5:
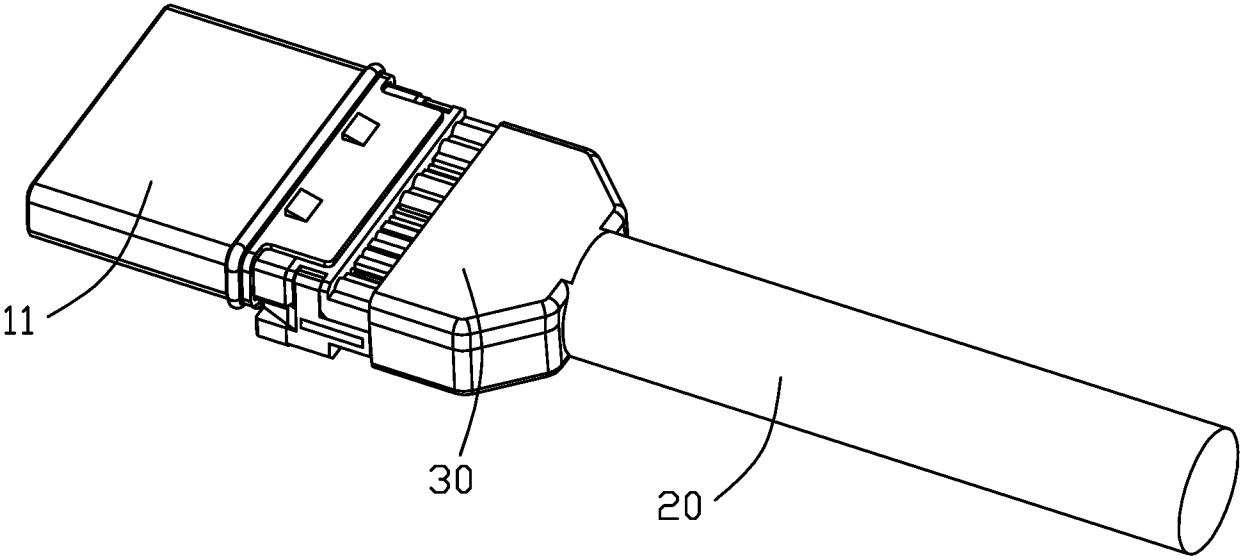
FIG. 5 is another perspective view of the cable of the cable connector assembly molding inner mold is connected with the plug as shown in FIG. 4.

Reference will now be made in detail to the embodiments of the present disclosure.

Referring to FIGS. 1-8, a HDMI cable connector assembly 100 according to the present invention includes an electrical connector 10 and a cable 20 electrically connected with the electrical connector 10. The electrical connector 10 includes a plug 11, a metal shell 12 disposed outside the plug 11 and the cable 20, and a middle shell 13. The cable 20 includes a plurality of core wires 21, an inner shield layer 22 covering the core wires 21, a metal braided layer covering outside the inner shield layer 22 in a construction and manner known to a person of ordinary skill in this art, and an outer cover layer 24. The HDMI cable connector assembly 100 further includes an inner mold 30 integrally formed on the core wire 21. The inner mold 30 fixes each core wire 21 at a predetermined position.

Figure 6:
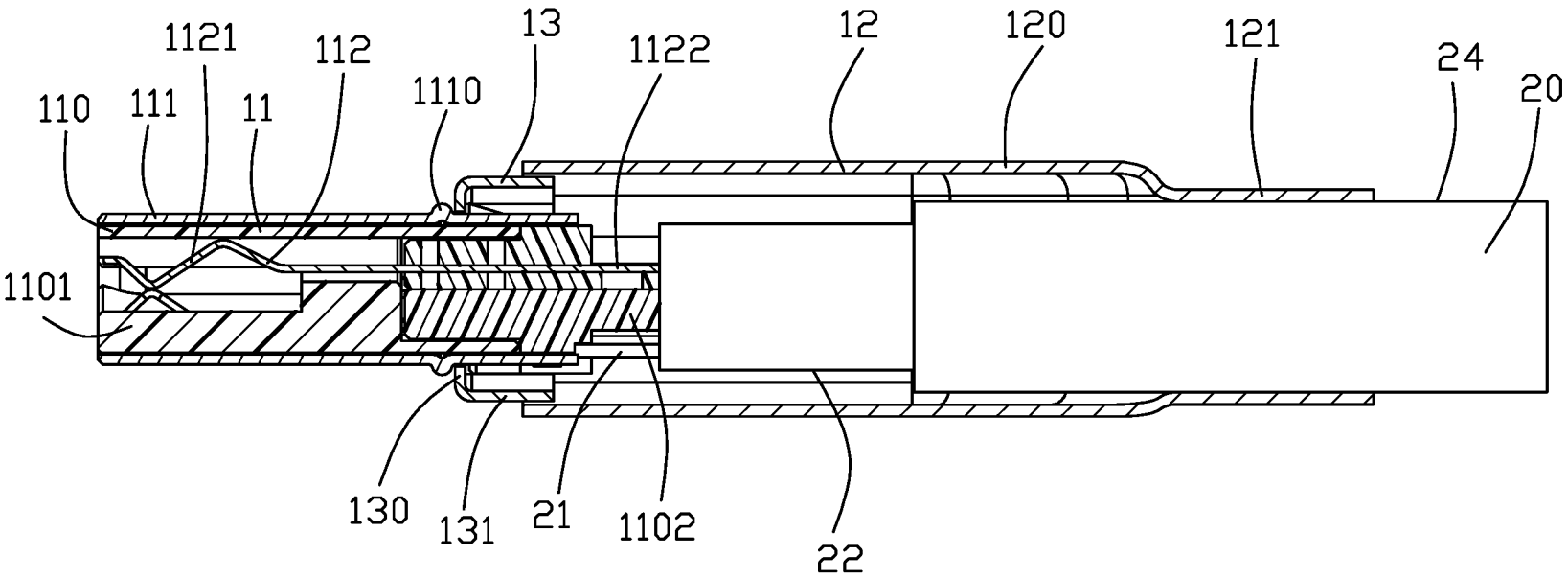
FIG. 6 is a cross-sectional view of the cable connector assembly taken along line 6-6 in FIG. 1.
Figure 7:
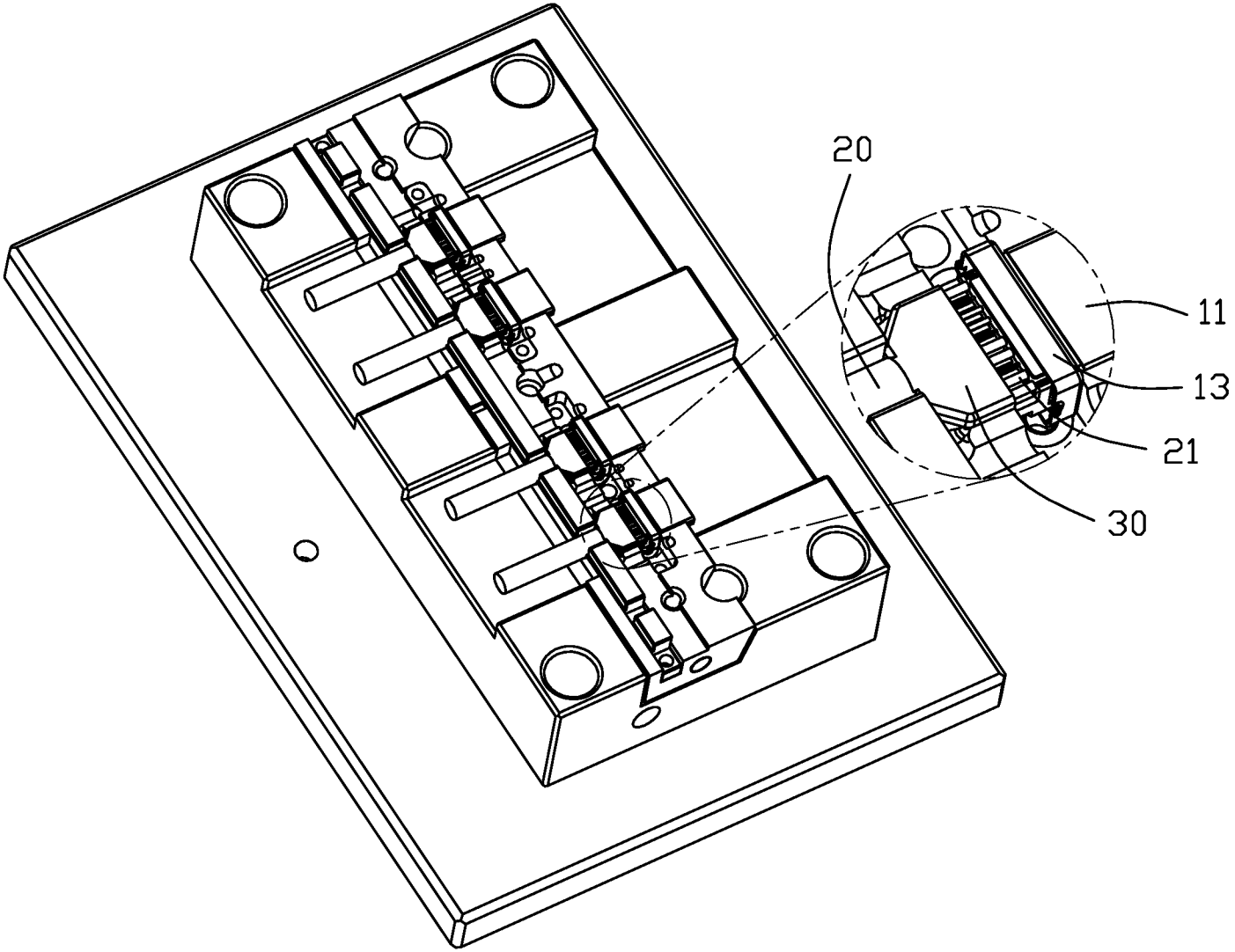
FIG. 7 is a perspective view of the cable of the cable connector assembly is molded into the inner mold as shown in FIG. 1.
Figure 8:
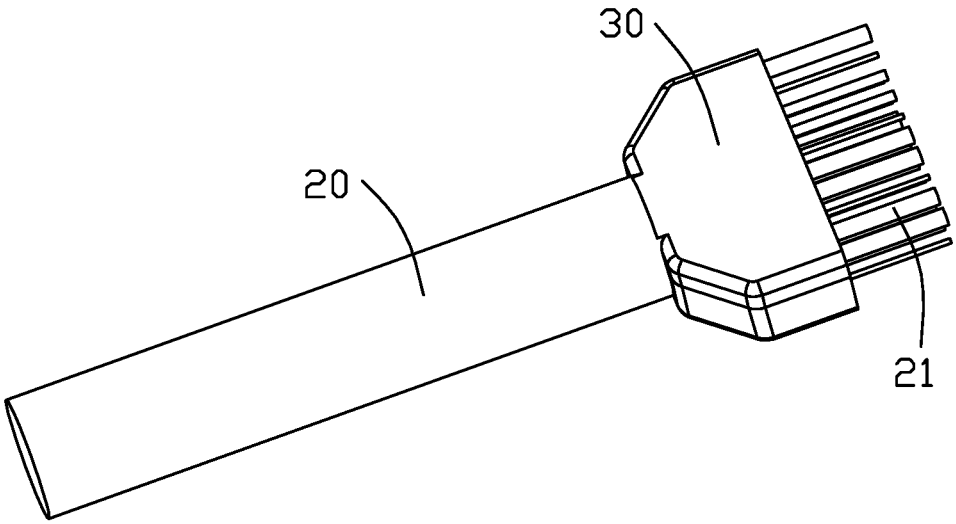
FIG. 8 is a perspective view of the cable is molded into the inner mold as shown in FIG. 7.

The plug 11 includes an insulative housing 110 with a front mating port 1101 for forward communication with an exterior and a rear connecting port 1102 for connection with the corresponding wires 21, a metal casing 111 disposed outside of the insulative housing 110, and a plurality of conductor terminals 112 received in the insulative housing 110 having a front mating section 1121 in the front mating port and a rear soldering tail 1122 in the rear connecting port, referring to FIG. 6. Notably, in this embodiment the terminals 112 are firstly insert-molded within the corresponding insulator (not labeled) and successively assembled into the housing 110. Anyhow, such an insulator may be deemed as a part of the insulative housing 110. The conductive terminals 112 are directly soldered with the corresponding core wires 21 to achieve electrical connection. The conductive terminals 112 and the corresponding core wires 21 can also be electrically connected directly or indirectly through a transfer circuit board or other connection methods. The metal casing 111 is made by stamping a metal strip. The metal casing 111 includes a position-limiting protrusion 1110 on the outer side of the metal casing 111, and the position-limiting protrusion 1110 is arranged around the entire outer side of the metal casing 111.

The metal shell 12 is a closed structure formed by a drawing process and includes a main body 120, a tail portion 121 connected with the main body 120. The tail portion 121 is sleeved on the outer side of the cable 20. The tail portion 121 is riveted with the cable 20.

The middle shell 13 is disposed between the metal casing 111 and the metal shell 12. The front end of the middle shell 13 is sleeved on the outer side of the metal casing 111, and the front end of the metal shell 12 is sleeved on an outer side of the middle shell 13. The middle shell 13 includes a front wall 130 and a peripherally closed side wall 131 extending rearwardly from the front wall 130. The front wall 130 is provided with a through hole 1300. The middle shell 13 is sleeved on the outer side of the metal casing 111 through the through hole 1300, and the mating position of the middle shell 13 and the metal casing 111 is defined by the limiting protrusion 1110.

The assembling method of the HDMI cable connector assembly 100 includes the following steps:

Providing a metal shell 12;

Providing a cable 20, the metal shell 12 is sleeved on the outside of the outer cover layer 24 of the cable 20;

Providing an insulative housing 110 with a plurality of conductive terminals 112 and electrically connecting the core wires 21 with the corresponding conductive terminals 112;

Providing a metal casing 111;

Providing a middle shell 13, the middle shell 13 is sleeved on the metal casing 111 in a back-to-front direction, and the limiting protrusion 1110 on the metal casing 111 will limit the mating depth of the middle shell 13, then mounting the metal casing 111 and the middle shell 13 together on the insulative housing 110 along the front-to-back direction, the middle shell 13 is disposed between the metal casing 111 and the metal shell 12;

Before the core wires 21 are soldered to the corresponding conductive terminals, first arrange the core wires 21 to a predetermined position on a mold, and then integrally mold the inner mold 30 on the core wires 21, the inner mold 30 fixes the core wire 21 at the predetermined position.

The front end of the middle shell 13 is sleeved on the outside of the metal casing 111, and the front end of the metal shell 12 is sleeved on an outer side of the middle shell 13.

The HDMI cable connector assembly 100 of the present invention further fixes each core wire 21 at a predetermined position through an inner mold 30 integrally formed on the core wire 21 without using a clamp, thereby saving materials and costs, and reducing the length of the peeled inner shield layer, which has better high-frequency performance. Specifically, the rear connecting port 1102 forms a plurality of grooves (not labeled) with the soldering tails of the terminals 112 therein to receive the corresponding core wires 21 soldering to the corresponding soldering tails of the corresponding terminals 112, respectively. The pitch of grooves are essentially same with that of the core wires positioned at the predetermined positions. Therefore, a relatively easy way can be made during soldering the core wires to the soldering tails of the corresponding terminals 112.

What is claimed is:

1. A cable connector assembly comprising:

an electrical connector including a plug and a metal shell disposed outside the plug;

a cable electrically connected with the electrical connector, the cable including a plurality of core wires;

a middle shell; and an inner mold integrally formed on the core wire to fix each core wire at a predetermined position; wherein the plug includes an insulative housing, a metal casing disposed outside the insulative housing, and a plurality of conductor terminals received in the insulative housing;

the metal shell includes a main body and a tail portion connected with the main body and sleeved on the outside of the cable;

the middle shell is disposed between the metal casing and the metal shell;

the front end of the middle shell is sleeved on the outside of the metal casing, and the front end of the metal shell is sleeved on the outside of the middle shell; and the middle shell includes a front wall and a peripherally closed side wall extending rearwardly from the front wall, the front wall is provided with a through hole, and the middle shell is sleeved on the outside of the metal casing through the through hole.

2. The cable connector assembly as claimed in claim 1, wherein the metal shell is a closed structure formed by a drawing process.

3. The cable connector assembly as claimed in claim 1, wherein the metal casing includes a position-limiting protrusion, and a mating position of the middle shell and the metal casing is defined by the protrusion.

4. A method of assembling a cable connector assembly, comprising the steps of:

providing a metal shell;

providing a cable including a plurality of core wires, an inner shield layer covering the core wires, and an outer cover layer, the metal shell being sleeved on the outside of the outer cover layer of the cable;

providing an insulative housing with a front mating port forward communication with an exterior and a rear connecting port forming a plurality of grooves;

providing a plurality of conductive terminals each having a front mating section in the front mating port and a rear soldering tail in the rear connecting port;

electrically connecting the core wires with the corresponding conductive terminals, respectively;

providing a metal casing; and providing a middle shell to sleeve on the metal casing in a front-to-back direction, and mounting the metal casing and the middle shell together on the insulative housing along the front-to-back direction, the middle shell being mounted between the metal casing and the metal shell; wherein before the core wires are soldered to the corresponding conductive terminals, first arranging the core wires to a predetermined position on a mold, and then integrally molding an inner mold on the core wires to fix the core wire at the predetermined position; wherein a front face of the inner mold abuts against a rear face of the rear connecting port in the front-to-back direction.

5. The method as claimed in claim 4, wherein the front end of the middle shell is sleeved on the outside of the metal casing, and the front end of the metal shell is sleeved on the outside of the middle shell.

6. A cable connector assembly comprising: an insulative housing defining, along a front-to-back direction, a front mating port forward communication with an exterior and a rear connecting port forming a plurality of grooves; a plurality of terminals retained in the housing, each of said terminals including a front contact section exposed in the front mating port and a rear soldering tail exposed in the corresponding grooves of the rear connecting port; and a cable having a plurality of core wires with corresponding exposed front end portions transversely arranged with one another at predetermined transverse positions corresponding to the corresponding grooves of the rear connecting port so as to solder the front end portions of the core wires to the solder tails of the corresponding terminals, respectively; wherein a pitch of the grooves is equal to that of the front end portions of the core wires at the predetermined transverse positions so as to have the exposed front end portions of the wires extending in a straight manner; wherein the cable is a round cable and includes an inner mold integrally formed at a front end of the round cable to enclose the front end portions of the core wires and maintain the front end portions of the core wires at the predetermined transverse positions; wherein a front face of the inner mold abuts against a rear face of the rear connecting port in the front-to-back direction.

* * * * *